United States Patent [19]

Lichtschlag

[11] Patent Number: 4,528,732

[45] Date of Patent: Jul. 16, 1985

[54] DEVICE FOR FORMING A THREAD CROSSING OR LEASE

[75] Inventor: Herbert Lichtschlag, Monchen-Gladbach, Fed. Rep. of Germany

[73] Assignee: Gebrüder Sucker, Monchen-Gladbach, Fed. Rep. of Germany

[21] Appl. No.: 364,887

[22] Filed: Apr. 2, 1982

[30] Foreign Application Priority Data

Apr. 3, 1981 [DE] Fed. Rep. of Germany ..... 3113485

[51] Int. Cl.[3] ..... D02H 9/00; D02H 13/16

[52] U.S. Cl. ..... 28/199; 28/181; 28/212

[58] Field of Search ..... 28/198, 199, 212, 181, 28/213

[56] References Cited

U.S. PATENT DOCUMENTS

| | | | |
|---|---|---|---|
| 500,097 | 6/1893 | Davenport | 28/199 |
| 2,044,578 | 6/1936 | Klein | 28/199 |
| 2,096,446 | 10/1937 | Bernhart | 28/199 |
| 2,107,004 | 2/1938 | Kaufmann | 28/212 |
| 2,152,432 | 3/1939 | Kaufmann | 28/199 |
| 2,462,581 | 2/1949 | Watson | 28/212 |
| 2,938,259 | 5/1960 | Stock | 28/199 |
| 2,950,518 | 8/1960 | Lindstrom | 28/213 |

FOREIGN PATENT DOCUMENTS

| | | | |
|---|---|---|---|
| 178550 | 11/1906 | Fed. Rep. of Germany | 28/212 |
| 215963 | 11/1909 | Fed. Rep. of Germany | 28/212 |
| 545965 | 3/1932 | Fed. Rep. of Germany | 28/198 |
| 2611353 | 9/1977 | Fed. Rep. of Germany . | |
| 2705266 | 8/1978 | Fed. Rep. of Germany | 28/198 |

*Primary Examiner*—Robert R. Mackey

*Attorney, Agent, or Firm*—Herbert L. Lerner; Laurence A. Greenberg

[57] ABSTRACT

Device for forming a thread crossing or lease in a textile machine, including a first comb being disposed in the path of the threads and having laminations defining interstices therebetween, a second comb being disposed obliquely relative to the first comb and having laminations defining interstices therebetween and tips on the laminations, the tips of the laminations of the second comb being engageable with equal distribution into the interstices of the first comb, every other interstice of the second comb being partially filled in providing alternately long and short interstices being open at the top thereof, and the combs being slideable relative to each other when engaged, and a method of operating the device.

11 Claims, 30 Drawing Figures

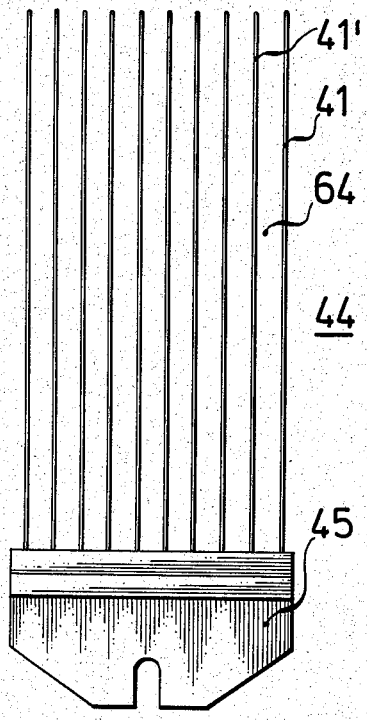
FIG. 4
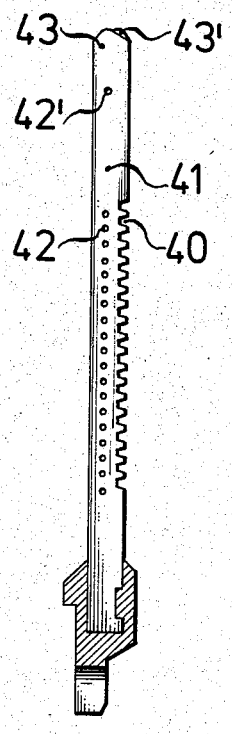
FIG. 5
FIG. 6
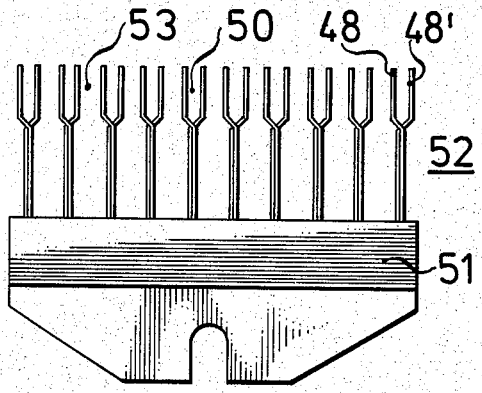
FIG. 7
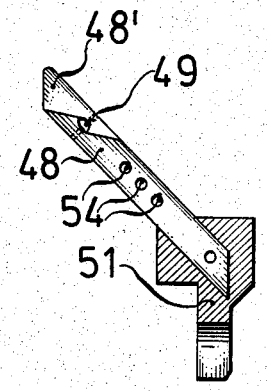

DEVICE FOR FORMING A THREAD CROSSING OR LEASE

The invention relates to a method and device for forming a thread crossing or lease in a textile machine, especially a sizing machine.

It is known from German Published, Non-Prosecuted Patent Application DE-OS No. 26 11 353, to make it possible to form a thread crossing or lease even in cases when more than one thread lies in each interstice. This is done by the provision that a first comb is placed in the path of the thread group, a second comb having the same divisions is placed at a small distance away, each second interstice at the second comb is filled by a lining in such a manner that alternately long and short interstices are formed which are open at the top, and that the combs can slide relative to each other in the vertical direction as well as around a partition in the horizontal direction. For the spacing of the threads, it is also known to provide the first comb with a number of holes for receiving lease rods, the holes being aligned obliquely relative to the direction of the thread groups. The lease rods have the form of needles with a round cross section.

During the operation of devices of this kind, disadvantages do exist. These are, for example, that the combs must be very ruggedly constructed, in order to absorb the side forces which are caused by the traversing motions. For this reason, the threads cannot be laid sideways with a desirable thread density. If these facts are neglected, the individual needles of the comb are deflected to the side during the traversing motion, and are no longer aligned with the corresponding other comb. In this case, the satisfactory operation of the device is not at all assured. Manufacture and set up costs of the known combs are also very high.

It is accordingly an object of the invention to provide a method and device for forming a thread crossing or lease, which overcomes the hereinafore-mentioned disadvantages of the heretofore-known methods and devices of this general type and to form a thread crossing or lease in a dense thread group with simple means.

With the foregoing and other objects in view there is provided, in accordance with the invention, a device for forming a thread crossing or lease in a textile machine, especially a sizing machine, comprising a first comb being disposed in the path of the threads and having laminations defining interstices therebetween, a second comb being disposed obliquely relative to the first comb and having laminations defining interstices therebetween and tips on the laminations, the tips of the laminations of the second comb being engageable with equal distribution into the interstices of the first comb, every other interstice of the second comb being partially filled in providing alternately long and short interstices being open at the top thereof and the combs being slideable relative to each other when engaged.

In accordance with another feature of the invention, the laminations of the first comb have edges facing toward the second comb and the edges have notches formed therein.

In accordance with a further feature of the invention, the notches formed in the edges have bottoms, and the laminations of the second comb engage in the interstices of the first comb only so far as to leave the bottom of the notches exposed or not yet covered.

In accordance with an added feature of the invention, the laminations of the first comb have holes formed therein for lease rods.

In accordance with an additional feature of the invention, the laminations of the first comb have asymmetrical tips.

In accordance with again another feature of the invention, every other one of the tips of the laminations of the first comb alternately point in the running direction of the thread and in the opposite direction.

In accordance with again a further feature of the invention, the first comb includes a stable foot part and the laminations of the first comb are in the form of stamped parts inserted as a package in the foot part.

In accordance with again an added feature of the invention, the laminations of the second comb are combined into pairs being crossed over each other at a given cross-over point forming a thread support.

In accordance with again an additional feature of the invention, the laminations of the second comb are disengaged at the given cross-over point over substantially half the width of the laminations.

In accordance with yet another feature of the invention, the second comb includes a stable foot part and the laminations of the second comb are in the form of stamped parts inserted as a package into the foot part.

In accordance with yet a further feature of the invention, there is provided a thread group traversing device disposed at a distance from the combs, as seen in the running direction of the threads.

New methods for forming a lease or thread crossing with the aid of the new device are proposed, and are described further hereinbelow.

The advantages achieved by the use of the invention are especially the fact that comb-alignment errors and thread crossing errors resulting therefrom can no longer occur. The combs can be made in a light construction with thin laminations, because every comb always guides and supports the other comb. Care was taken in the construction, so that the combs are assembled from individual parts which are easily manufactured in quantity. In the second comb, special additional measures for closing every second interstice, such as soldering operations, can be omitted. The insertion of the threads into the first comb is facilitated by the special configuration of the reed endings. The traversing of the thread groups according to the invention is not critical at all, and can therefore be done with more or less amplitude. The individual parts of the combs are mass-produced parts, and their assembly into finished combs is also rather simple.

In accordance with a first mode of the invention, there is provided a method of operating a device for forming a lease in a textile machine, including a traversing device for traversing the threads to first and second (right and left) sides, which comprises reeding the threads into the first comb to place the threads in at least two levels in the interstices of the first comb, subsequently traversing all of the threads to the first (right) side with the traversing device, subsequently moving the second comb from below to the end position placing the threads in the short interstice higher than the threads in the long interstice of the second comb to form a first lease, placing first a lease rod or the like into the first lease, subsequently moving the second comb downward, traversing the threads to the second (left) side, moving the second comb up again forming a second lease, placing a second lease rod or the like into the second lease, and moving the second comb to the starting position.

In accordance with a second mode of the invention, there is provided a method of operating a device for forming a thread crossing in a textile machine, which comprises reeding the threads into the first comb to place the threads in at least two levels on top of each other in the interstices of the first comb, subsequently traversing the threads to the second (left) side, subsequently moving the second comb up from below until the threads of the lower level lie in the interstices of the second comb, subsequently traversing the threads to the first (right) side, subsequently moving the second comb up until the threads of the second level from below lie in the interstices of the second comb, continuing this movement from level to level until all of the threads are picked up by the second comb, subsequently moving the second comb into the upper end position to form a lease from the threads behind the second comb, placing a lease rod or the like into the lease, subsequently moving the second comb down again, and repeating the operation again with the difference that the threads are initially traversed to the first (right) side, i.e. to the opposite side.

Other features which are considered as characteristic for the invention are set forth in the appended claims.

Although the invention is illustrated and described herein as embodied in a device for forming a thread crossing or lease, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 3 is a side-elevational view of the finished lease;

FIG. 4 is a front-elevational view of a reed or comb segment of a first comb;

FIG. 5 is a side-elevational view of FIG. 4;

FIG. 6 is a front-elevational view of a reed segment of a second comb;

FIG. 7 is a side-elevational view of FIG. 6;

Figure 13A:
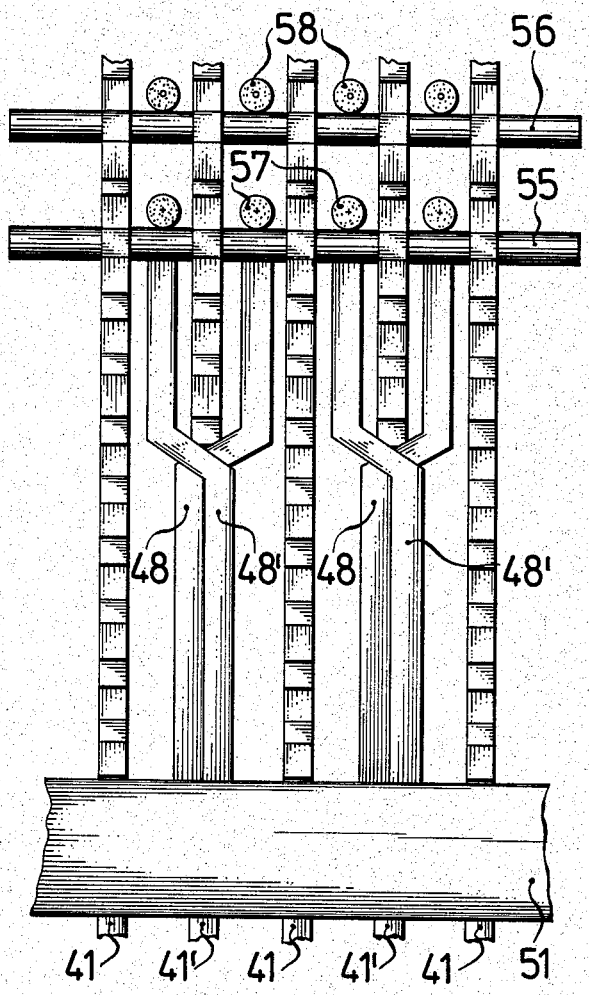
Figure 13B:
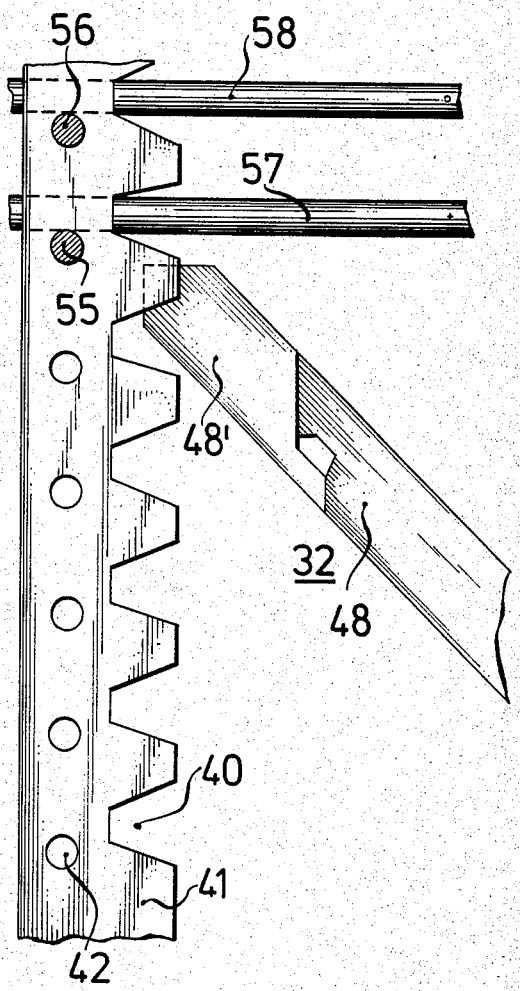
Figure 14A:
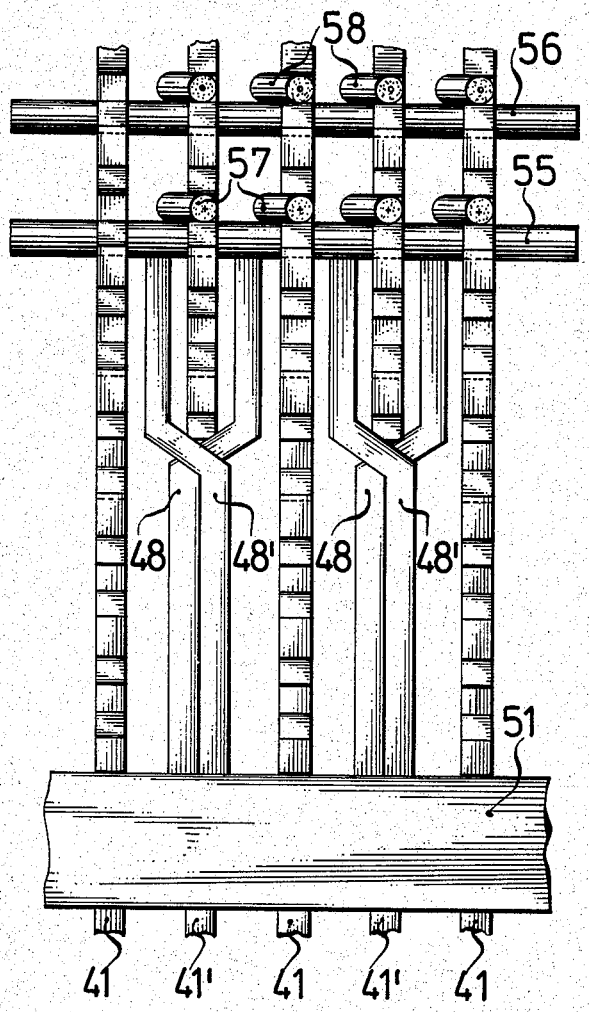
Figure 14B:
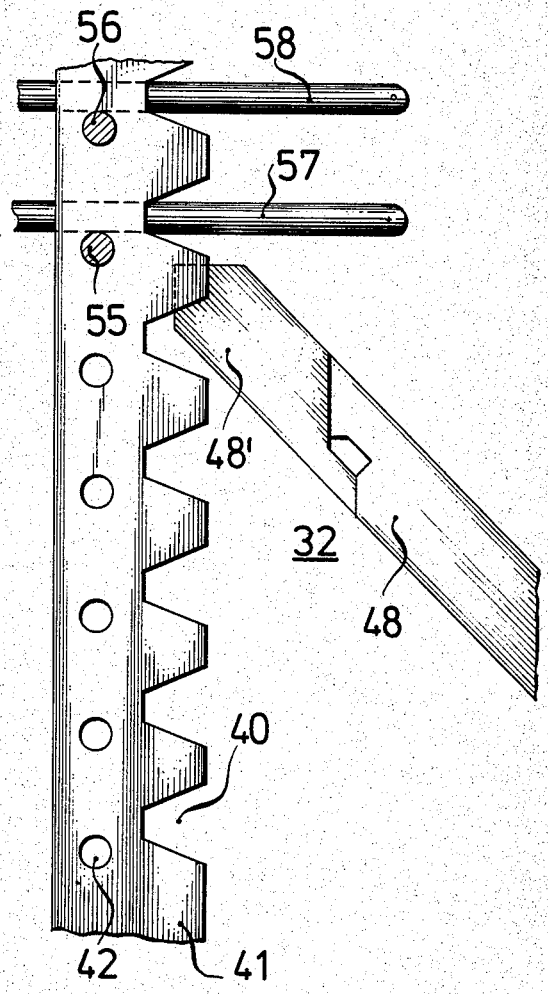
Figure 15B:
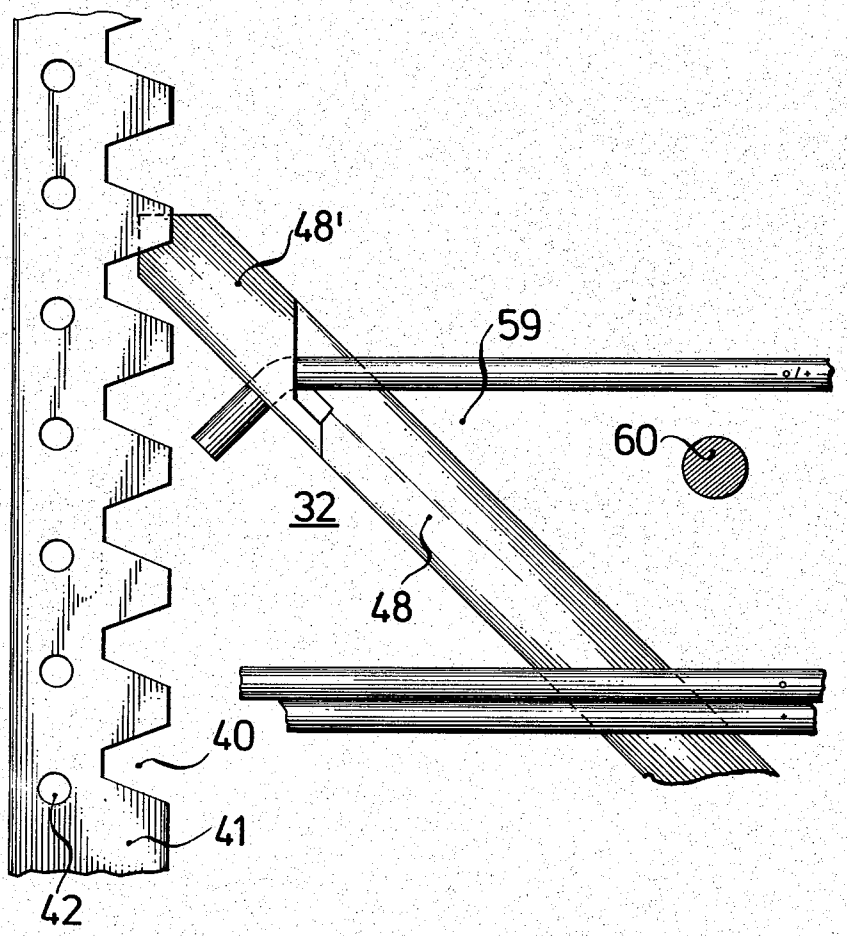
Figure 15A:
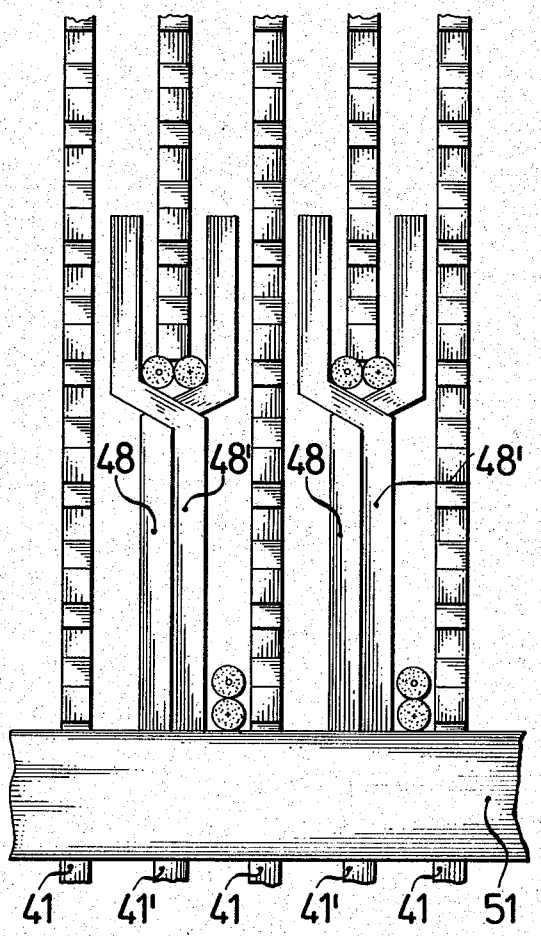
Figure 16A:
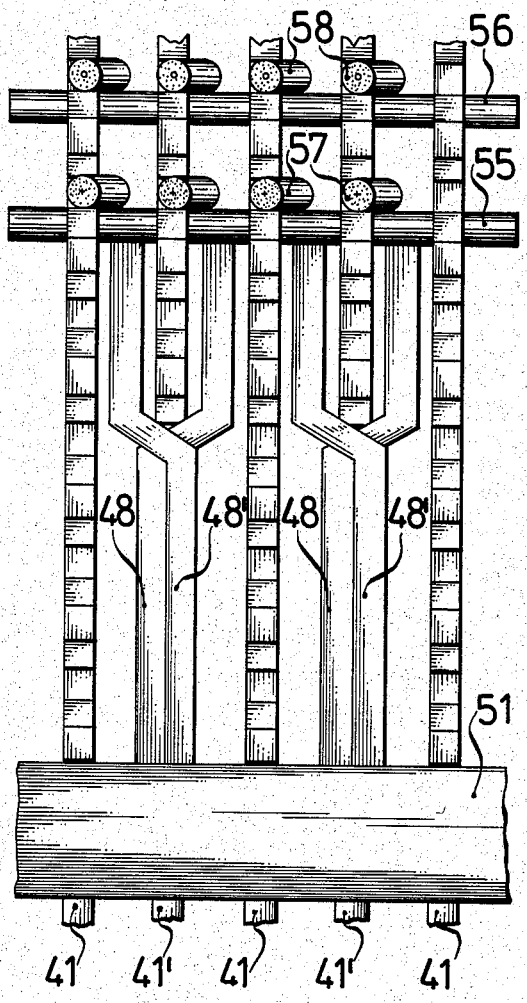
Figure 21B:
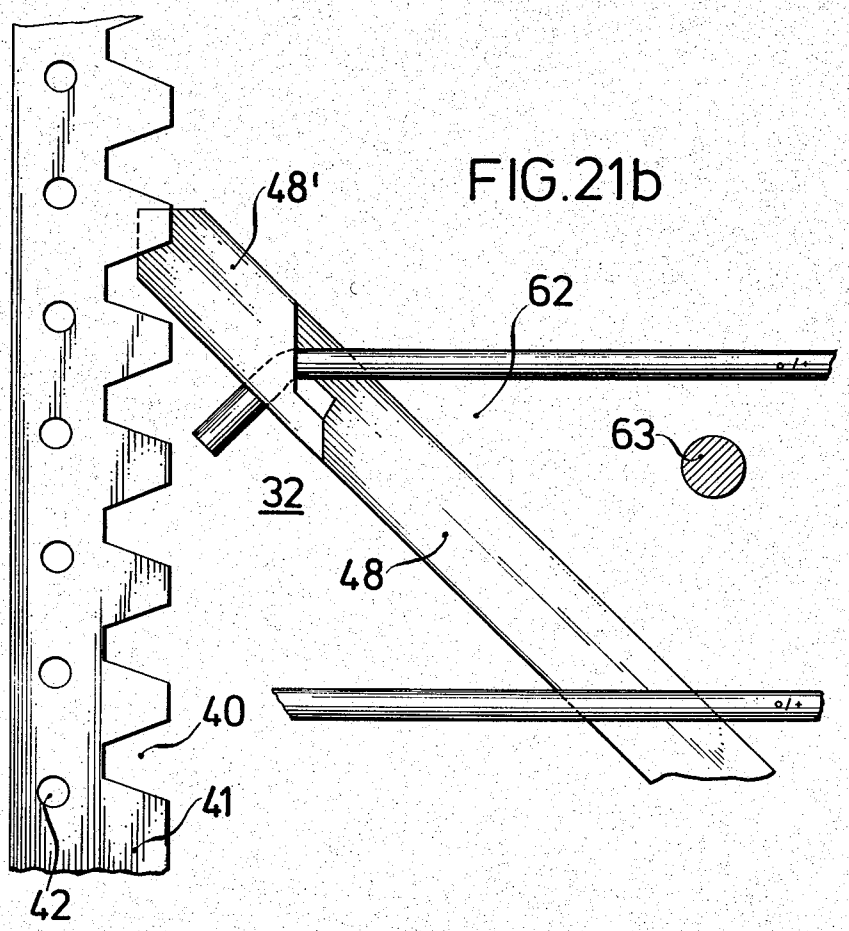
Figure 21A:
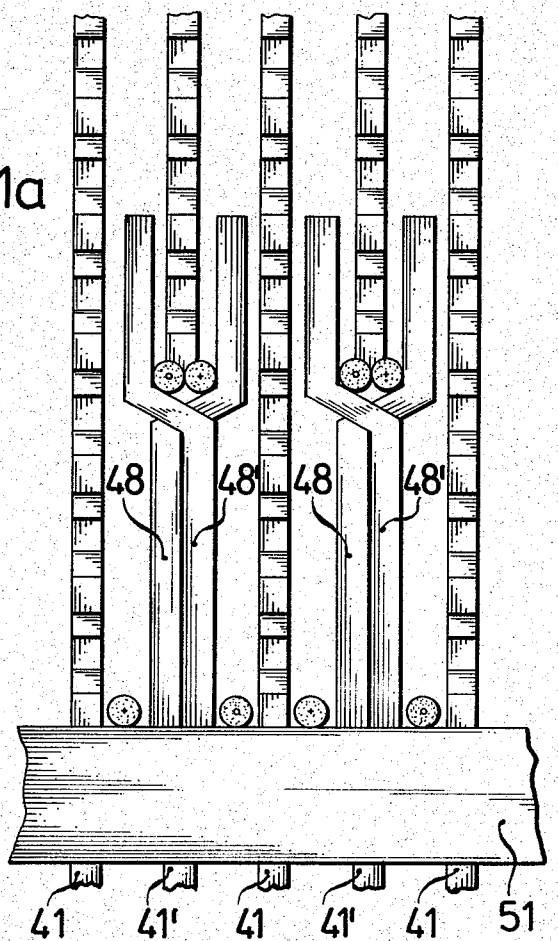

FIGS. 13*a* and *b* to FIGS. 15*a* and *b* are fragmentary diagrammatic side-elevational views showing the formation of a lease in several phases; and FIGS. 16*a* and *b* to FIGS. 21*a* and *b* are views similar to FIGS. 13–15 showing the formation of a thread-crossing in several phases.

Figure 1:
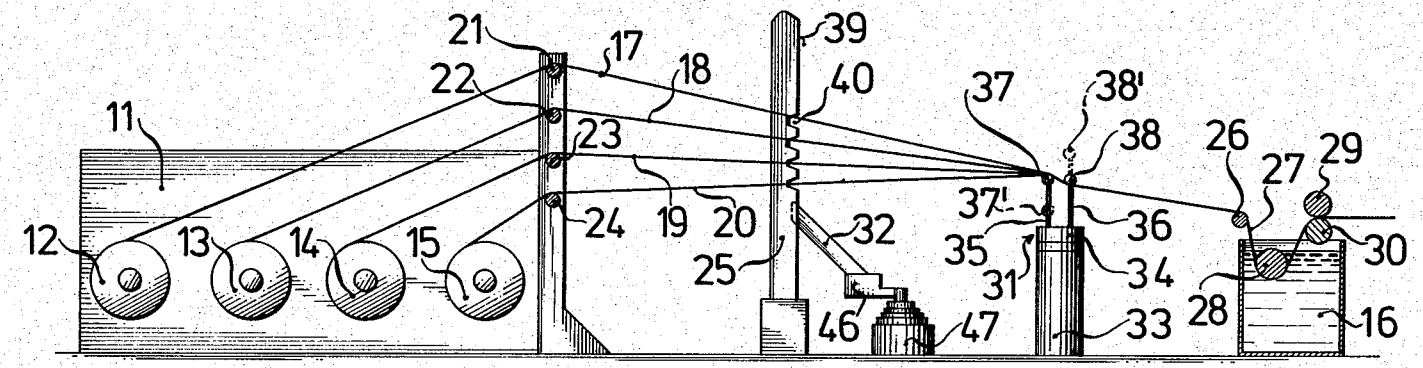
FIG. 1 is a diagrammatic side-elevational view of a sizing machine with the device according to the invention.

Referring now to the figures of the drawing and first particularly to FIG. 1 thereof, there is seen a warp beam frame 11 with four warp beams 12, 13,14, 15. A group of threads runs from each warp beam to a sizing trough 16. Specifically, the thread group 17 runs from the warp beam 12, the thread group 18 from the warp beam 13, the thread group 19 from the warp beam 14, and the thread group 20 from the warp beam 15. The thread groups run in four levels disposed on top of each other over lease, shed or split rods 21, 22, 23, 24 through a first comb 25. In each interstice of the first comb 25 lie four threads, each coming from a different warp beam.

The thread groups are united to form a single group of threads 27 in a traversing device 31. The thread group 27 runs over a deflection roller 26 and another deflection roller 28 through the sizing-trough 16. From the trough 16, the thread group 27 runs over squeezing rollers 29, 30 into a drying device, which is not illustrated in the drawing. After they leave the drying apparatus, the threads are wound on a warp beam. Thus, the threads which were first individually guided through the comb 25 are united to form the thread group 27 for sizing. The thread group which is sometimes still coalesced after sizing, is again divided step by step after the drying device, in such a manner that the threads are again individually positioned as in the comb 25.

To allow a reliable separation into individual threads after the sizing operation, so that before and after the actual sizing device the same arrangement of the individual threads exists, a lease or a thread-cross is formed with the aid of a second comb 32 in the area between the comb 25 and the traversing device 31.

The following is to be explained with respect to the details of the traversing device 31:

A bar 34 is disposed on a base 33 so that it can traverse across the direction of the thread group 27. The bar 34 carries bearing supported rods 37, 38 on supports 35, 36. The bearing supported rods 37, 38 can be moved vertically into the position 37′, 38′, respectively. In the position shown, the rods 37, 38 form a clamping line for the thread group 27. In this embodiment, only 5 cm are traversed in both directions. The following applies for the construction of the first comb 25: The first comb 25 is formed of laminations which are combined into individual reed or comb segments. The laminations have notches 40 at their edges 39 pointing toward the second comb 32. For simplicity only four notches are provided in this case, which lie at the respective elevation of the separate thread groups.

Deviating from the representation in FIG. 1, according to FIGS. 4 and 5, the laminations 41 and 41′ can be provided with lease rod insertion holes 42. In this case, the laminations, droppers or drop wires also have asymmetrical tips 43, 43′, respectively. The tip 43′ of every other lamination 41′ points in the thread-run direction, and the tip 43 of each other lamination 41 points against the thread-run direction. In this manner, the reeding-in of the threads at the tip of the laminations can be facilitated. FIG. 4 shows that ten laminations are combined in a common foot part 45, forming a reed segment designated as a whole with reference symbol 44 with interstices 64. This foot part 45 is made of tin, into which the laminations are cast. FIG. 5 shows that in this alternative embodiment, nineteen similar notches 40 are provided. Nineteen lease rod insertion holes 42 are also provided with the notches, as well as an additional lease rod insertion hole 42′. These lease rod insertion holes are arranged in such a way that a thread which is guided over an inserted lease rod always lies at the side of a notch.

The drawings of FIGS. 4 and 5 also show that the laminations 41, 41' of the first comb are formed as stamped parts, and are anchored as a package in the stable foot part 45.

The following is to be explained with respect to the second comb 32: The comb 32, with the same division as the comb 25, is also formed of laminations having tips which, in the operating state, engage in the interstices of the first comb 25, as shown in FIG. 1. In this engaged state, the comb 32 is parallel to the comb 25, and is disposed in such a manner that it can slide. For this purpose, the comb 32 is provided with a bar 46 which is fastened to an elevating mechanism 47. The elevating mechanism 47 has a telescope-like construction. Further details of the second comb are shown in FIGS. 6 to 12 of the drawings.

FIG. 6 shows that the laminations 48, 48' are combined in pairs, and that they cross over in pairs at a cross-over point 49. The laminations 48, 48' are disengaged over approximately half of the lamination width at the cross-over point.

Figure 8:
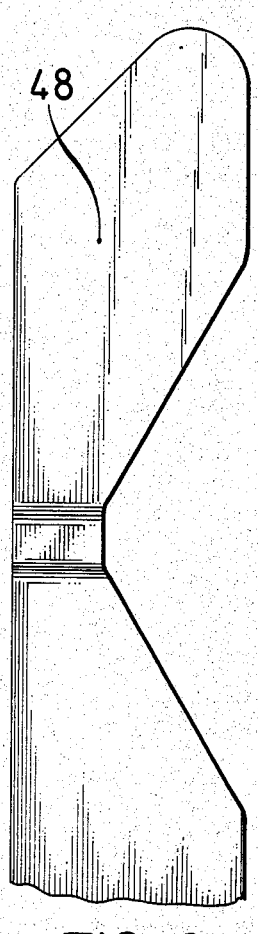
FIG. 8 is a fragmentary side-elevational view of the upper end of a lamination, dropper or drop wire of the second comb.
Figure 9:
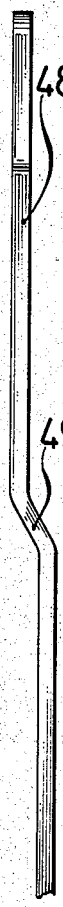
FIG. 9 is a front-elevational view of FIG. 8.
Figure 10:
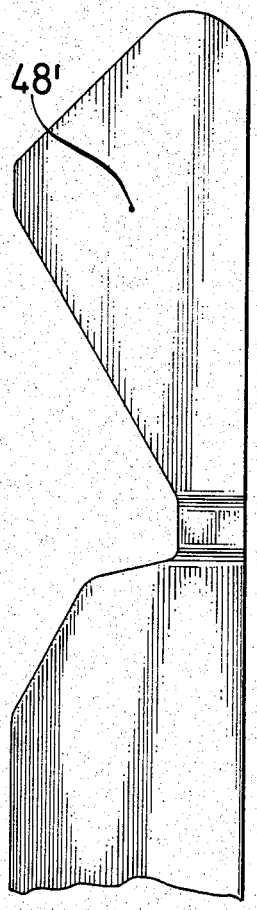
FIG. 10 is a view similar to FIG. 8 of the upper end of the corresponding lamination of the second comb.
Figure 11:
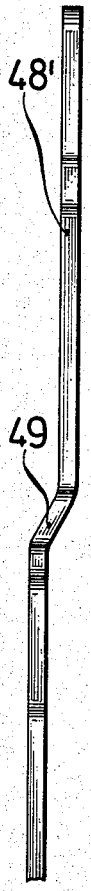
FIG. 11 is a front-elevational view of FIG. 10.
Figure 12:
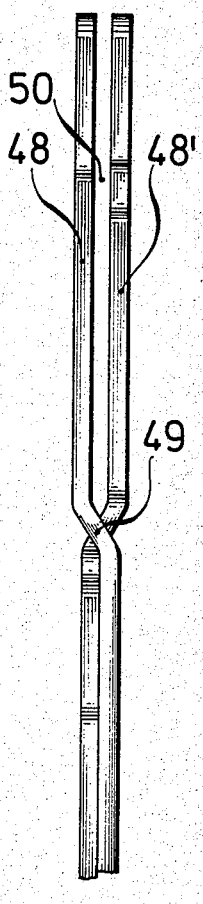
FIG. 12 is a front-elevational view of two corresponding laminations of the second comb in a combined condition.

The drawings of FIG. 8 to FIG. 12 show further details of the crossover. In FIGS. 8 and 9, it is shown how the lamination 48 is disengaged and bent at the cross-over point 49. The drawings of FIGS. 10 and 11 show how the corresponding lamination 48' is offset, and angled at the cross-over point 49. FIG. 12 shows the two laminations 48, 48' joined together, in a front view. Above the cross-over point 49, a short interstice 50 is formed, as also seen in FIG. 6. The cross-over point 49 provides support for thread, as can be clearly seen from FIG. 12.

According to FIG. 6, twenty laminations are embedded in pairs of two pieces each in a foot part 51, and form a reed segment 52 in this way. A long interstice or space 53 always follows a short interstice or space 50. FIG. 7 shows that the laminations 48, 48' are each provided with three holes 54 for insertion of reed needles. By use of the reed needles, a suitable support for the threads can be provided.

Figure 2:
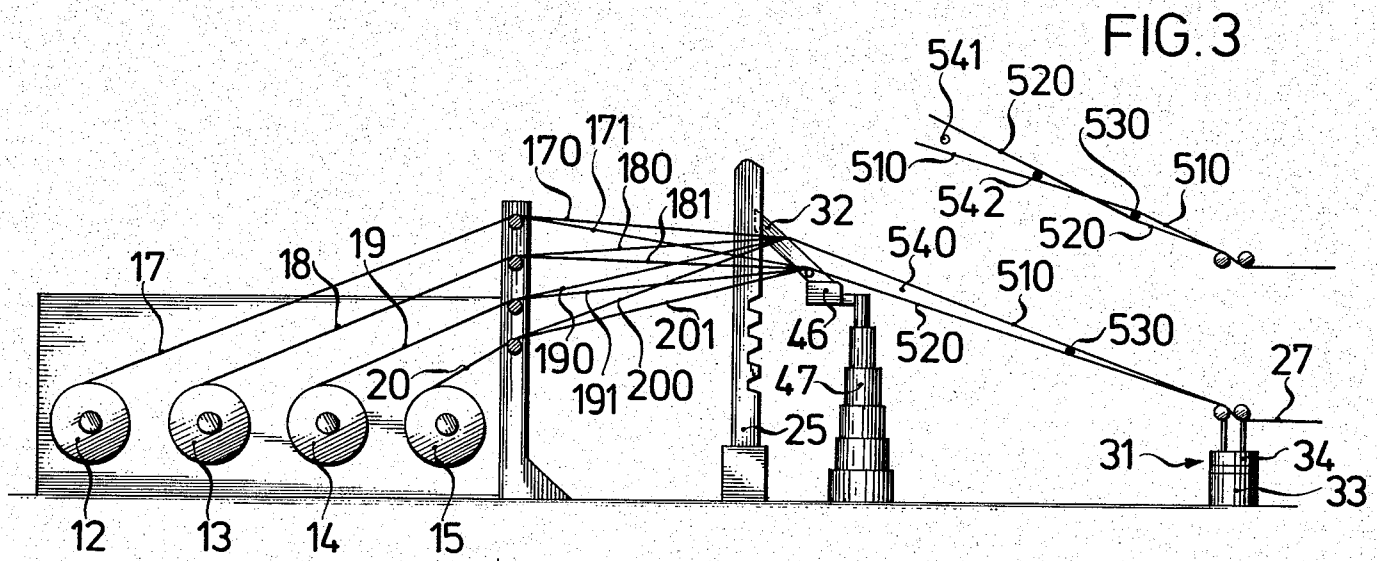
FIG. 2 is a side-elevational view of a part of the same machine as it forms a lease.

If the traversing device 31 traverses the thread groups 17 to 20 to the left or to the right, and when thereafter the second comb 32 is moved vertically upward into the upper position as shown in FIG. 2, a new arrangement of the thread groups results. In this way the thread group 17 divides into thread groups 170, 171, the thread group 18 into thread groups 180, 181, the thread group 19 into thread groups 190 and 191, and the thread group 20 into thread groups 200 and 201. The thread groups 170, 180, 190 and 200 which are guided in the short interstices of the second comb 32 are united to form a thread group 510, and the thread groups 171, 181, 191, 201 which are guided in the long interstices of the second comb 32 are united to form a thread group 520. Only after the traversing mechanism 31, are all threads united again to form the thread group 27. A lease or shed 540 has been formed between the reed arrangement and the traversing device, with a lease rod 530 disposed in the lease.

When the second comb 32 is subsequently lowered again and moved to the lower end position, the thread groups are thereafter traversed to the opposite side, and the second comb is again moved to the upper position, the thread groups 171, 181, 191, 201 are now positioned in the short interstices, and the thread groups 170, 180, 190, 200 are positioned in the long interstices of the second comb 32. Accordingly, as shown in FIG. 3, the thread group 520 now lies on top, and the thread group 510 lies below. A lease rod 542 is now laid into the thus formed lease 541. Thereby, a lease has been produced. By means of the lease rod 530 and 542, cross filaments can now be pulled through. Before the sizing process is begun, the second comb 32 is again disengaged from the thread groups, and moved down to the starting position, shown in FIG. 1. The cross filaments serve a purpose which is that after the sizing operation, in spite of a possible coalescence of the threads, the desired thread distribution can again be produced, which otherwise might not be easily accomplished due to the absence of the threads.

The formation of a lease and a crossweb will now be explained in detail with the aid of the simplified drawings of FIGS. 13*a* and *b* to FIGS. 21*a* and *b*.

First it is pointed out with respect to the drawings, that they show in fragmentary view, three laminations 41 and two laminations 41' of the first comb 25. The laminations are provided with notches 40, and with holes 42 for inserting the lease rods. Regarding the second comb 32, a diagrammatic view partially shows the foot part 51, and two double sets of the laminations 48, 48'. Lease rods 55, 56 are inserted in two lease rod insertion holes 42 which lie on top of each other. The lease rods serve as supports for the thread groups 57, 58 which are disposed in two levels. The threads of the lower thread group are indicated by a cross, and the threads of the upper thread group are indicated by a dot.

In the typical embodiments shown, only one thread lies in each interstice of the first comb. The drawings showing a front view have the subscript a, and the respective side view has the subscript b.

The formation of a lease will now be further explained with the aid of FIGS. 13 to 15.

In the starting position according to FIG. 13, the threads have already been reed-in, and the lease rods 55 and 56 are inserted. The second comb 32 remains in the starting position below the thread groups 57, 58. According to FIG. 14, all of the threads are now traversed to the right. Thereafter, the second comb 32 is moved to the upper end position, according to FIG. 15. Each second thread which previously was in the upper level, is now located in the lower level. Likewise, every second thread which was previously in the lower level is now in the upper level. A lease 59 is formed in this way, in which a lease rod 60 is now laid in. Subsequently the second comb is again moved into the starting position, and the hereinafore-described operation is repeated, with the difference that all threads are first traversed to the left. After the subsequent insertion of the second lease rod, the forming of the lease is finished, except for the insertion of the cross filaments.

Figure 16B:
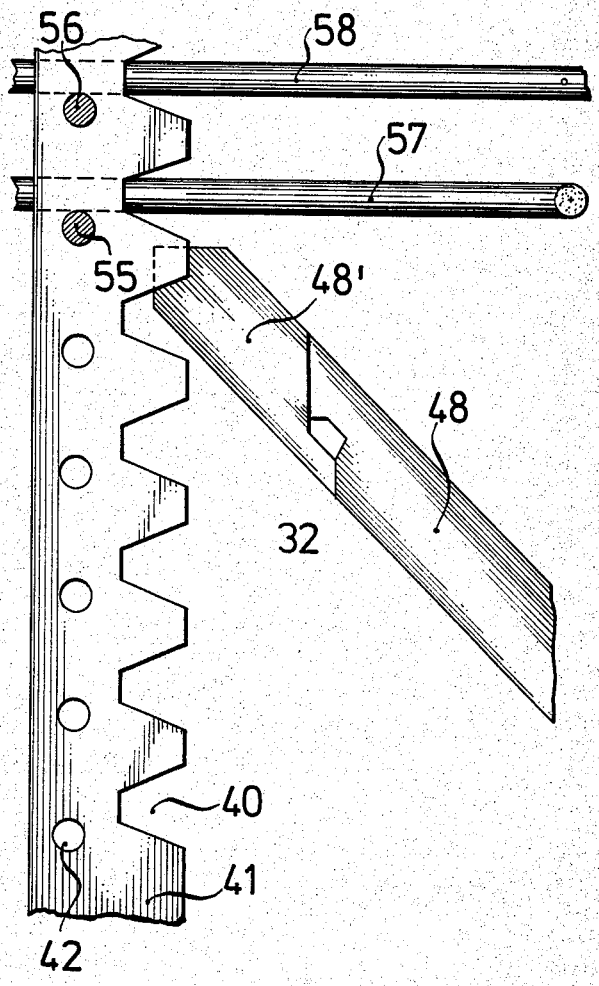
Figure 17A:
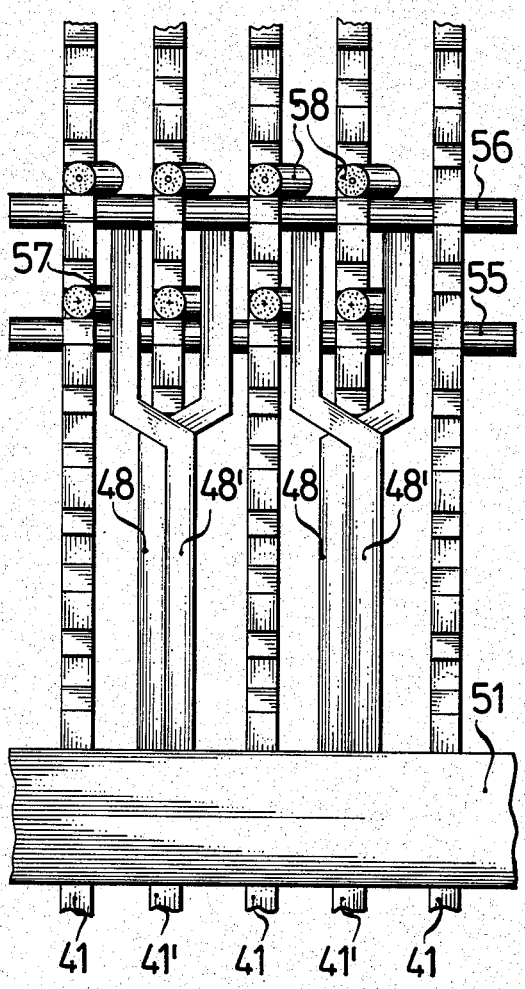
Figure 17B:
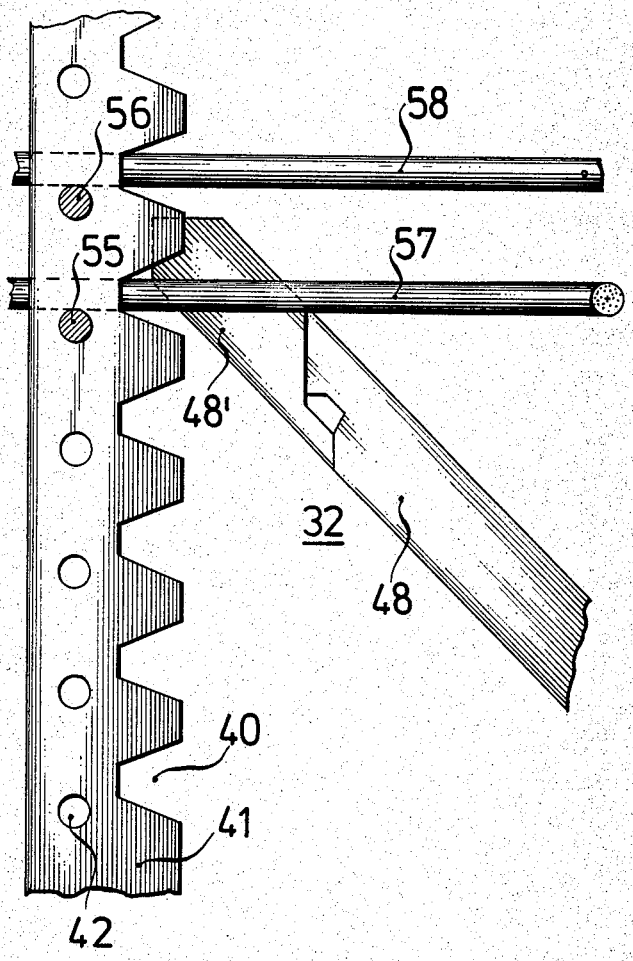
Figure 18A:
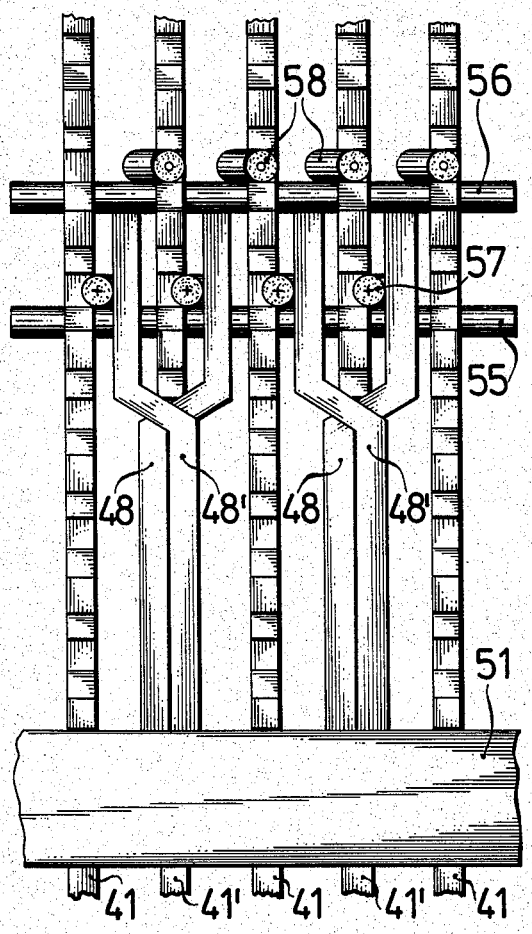
Figure 18B:
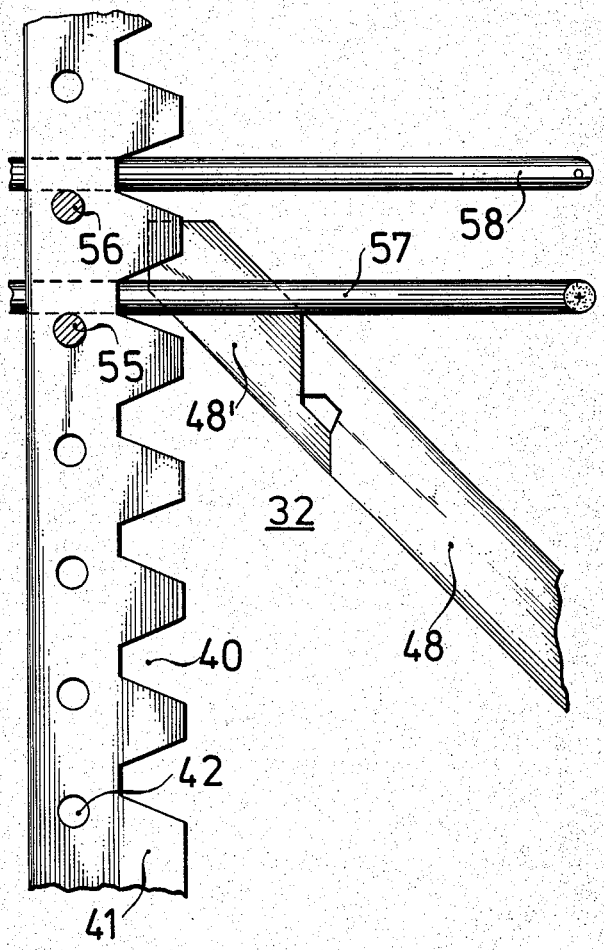
Figure 19A:
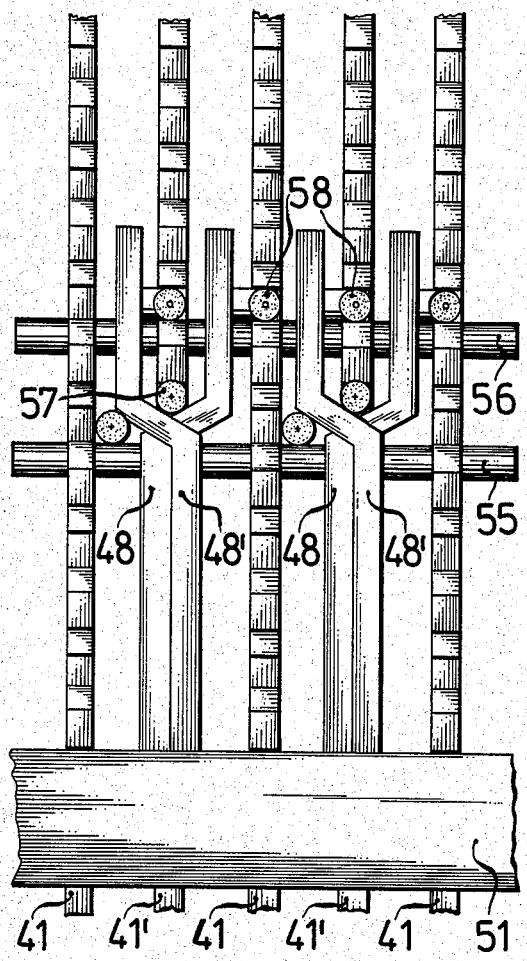
Figure 19B:
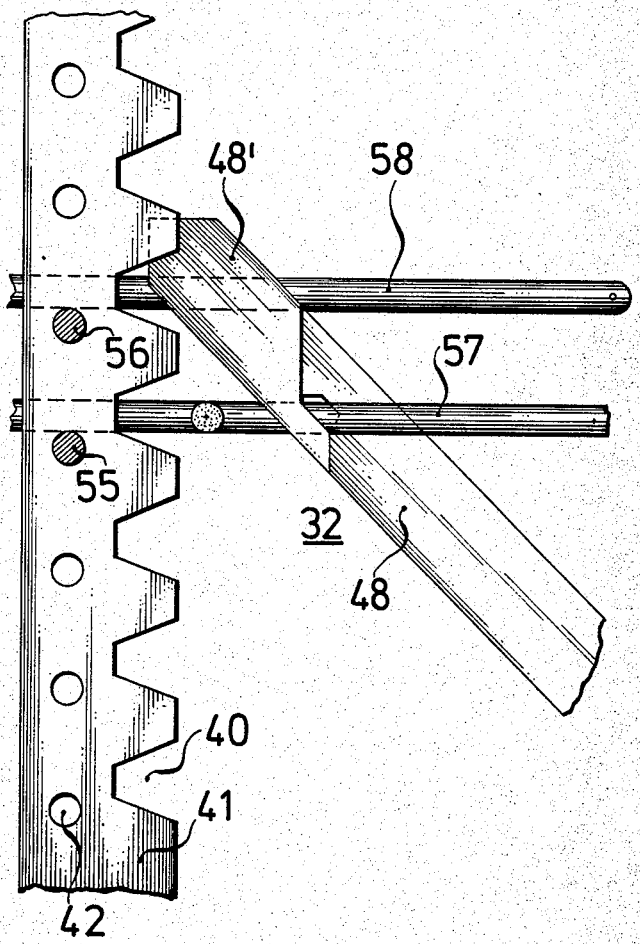
Figure 20B:
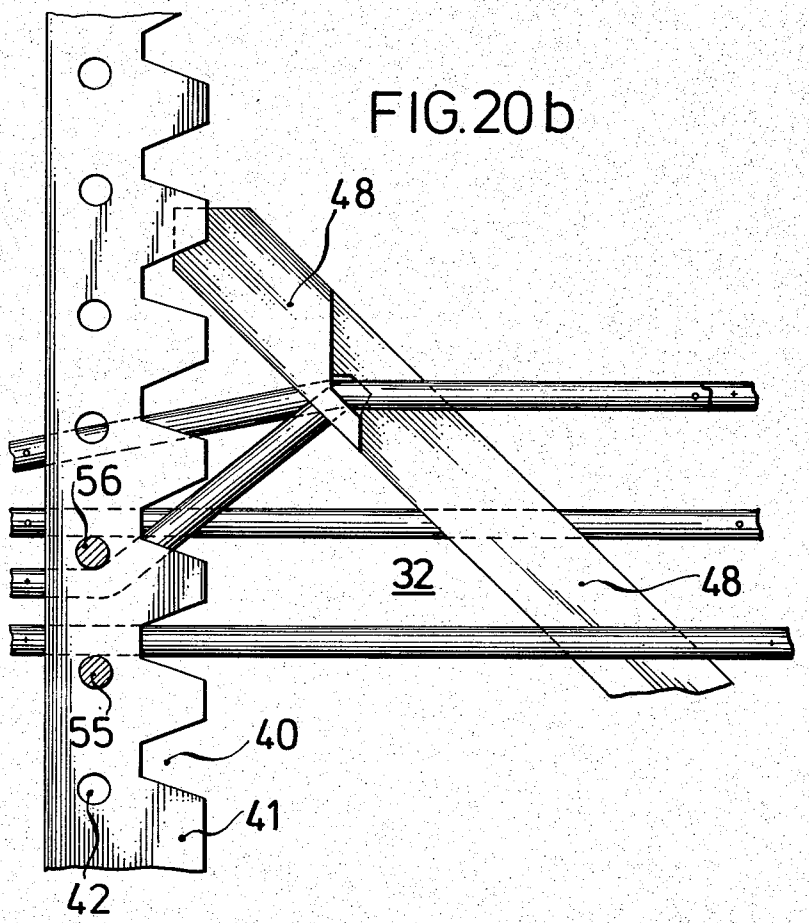
Figure 20A:
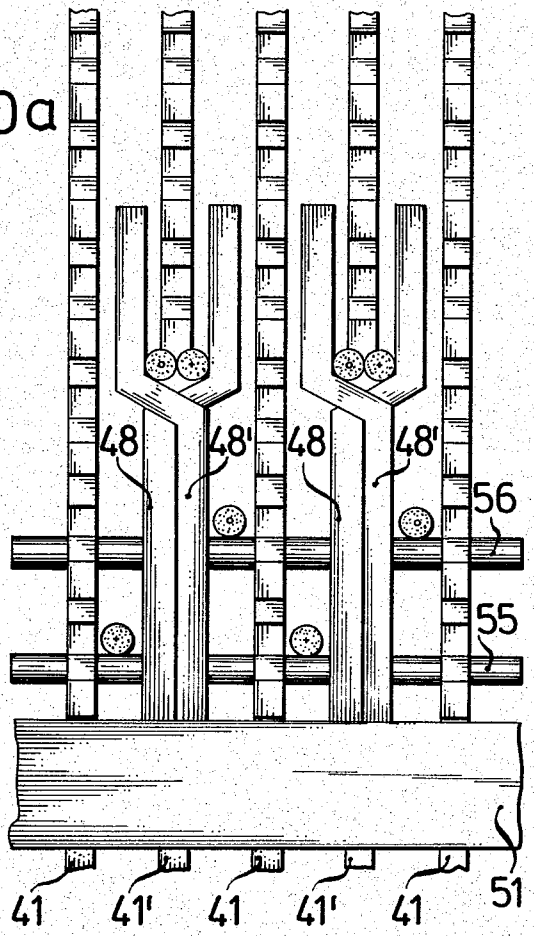

The formation of a thread crossing will be explained with the aid of the drawings of FIGS. 16 to 21. The starting position corresponds to FIG. 13 of the preceding example. FIG. 16 shows that the threads are first traversed to the left. Thereafter, the second comb 32, according to FIG. 17 is moved up to a height at which the laminations enter between the threads of the lower level, but do not reach between the threads of the upper level. Then the threads are traversed to the right, as shown in FIG. 18. Subsequently, the second comb is raised further. The first stage of the upward motion is shown in FIG. 19. In FIG. 19, in connection with FIG. 18, it is illustrated that the small interstices of the second comb 32 always collect threads which originate from two adjacent interstices of the first comb 25, in contrast to the operation when forming the lease. FIG. 20 shows that as the second comb is further raised, the threads lying in the small interstice are moved further higher, in contrast to the remaining threads which are not lifted further. FIG. 21 shows the upper end position of the second comb 32. A lease 62 has been formed, into which a lease rod 63 is laid.

To complete the thread crossing, the second comb 32 is now moved down again into the starting position. The above-described operation is then repeated, with the difference that at the beginning the threads are not traversed to the left as shown in FIG. 16, but instead to the opposite side to the right. The thread crossing is completed when a lease rod is also inserted into the second lease. Subsequently, the second comb 32 is lowered a second final time to the starting position. By means of the inserted lease rods, cross filaments can now be pulled through the leases.

I claim:

1. Device for forming a thread crossing or lease in a textile machine, comprising a first comb being disposed in the path of threads and having laminations defining interstices therebetween, a second comb being disposed obliquely relative to said first comb and having laminations defining interstices therebetween and tips on said laminations, said tips of said laminations of said second comb being engageable with equal distribution into said interstices of said first comb, every other interstice of said second comb being partially filled in providing alternately long and short interstices being open at the top thereof, and means for permitting relative motion between said first and second combs and for maintaining said tips of said laminations of said second comb in permanent engagement in said interstices of said first comb.

2. Device according to claim 1, wherein said laminations of said first comb have edges facing toward said second comb and said edges have notches formed therein.

3. Device according to claim 2, wherein said notches formed in said edges have bottoms, and said laminations of said second comb engage in said interstices of said first comb only so far as to leave said bottoms of said notches exposed.

4. Device according to claim 1, wherein said laminations of said first comb have holes formed therein for lease rods.

5. Device according to claim 1, wherein said laminations of said first comb have asymmetrical tips.

6. Device according to claim 5, wherein said tips of said laminations of said first comb alternately point in the running direction of the thread and in the opposite direction, for facilitating reeding of the threads at the tips.

7. Device according to claim 1, wherein said first comb includes a foot part and said laminations of said first comb are in the form of stamped parts inserted as a package in said foot part.

8. Device according to claim 1, wherein said laminations of said second comb are combined into pairs being crossed over each other at a given cross-over point forming an open-ended thread support.

9. Device according to claim 8, wherein said laminations of said second comb are disengaged at said given cross-over point over substantially half the width of said laminations.

10. Device according to claim 8 or 9, wherein said second comb includes a foot part and said laminations of said second comb are in the form of stamped parts inserted as a package into said foot part.

11. Device according to claim 1, including a thread group traversing device disposed at a distance from said combs, as seen in the running direction of the threads.

* * * * *